US010716993B2

(12) United States Patent
Dinwiddie

(10) Patent No.: US 10,716,993 B2
(45) Date of Patent: Jul. 21, 2020

(54) THREE-DIMENSIONAL ARCH PUZZLE

(71) Applicant: Joseph Allen Dinwiddie, Black Mountain, NC (US)

(72) Inventor: Joseph Allen Dinwiddie, Black Mountain, NC (US)

( * ) Notice: Subject to any disclaimer, the term of this patent is extended or adjusted under 35 U.S.C. 154(b) by 0 days.

(21) Appl. No.: 16/220,182

(22) Filed: Dec. 14, 2018

(65) Prior Publication Data

US 2019/0184277 A1 Jun. 20, 2019

Related U.S. Application Data

(60) Provisional application No. 62/598,681, filed on Dec. 14, 2017.

(51) Int. Cl.
*A63F 9/12* (2006.01)
*A63F 9/00* (2006.01)

(52) U.S. Cl.
CPC ..... *A63F 9/1288* (2013.01); *A63F 9/0076* (2013.01); *A63F 2009/1292* (2013.01); *A63F 2009/1296* (2013.01); *A63F 2250/50* (2013.01)

(58) Field of Classification Search
CPC ..... A63F 9/1288; A63F 2250/50; A63F 2009/1296; A63F 2009/1292; A63H 33/044; E04B 1/32; E04E 21/1866; E01D 4/00; E01D 2101/22; E06B 1/68
See application file for complete search history.

(56) References Cited

U.S. PATENT DOCUMENTS 1,568,252 A 1/1926 Strub et al.
2,480,902 A * 9/1949 Boyer ..... A63F 9/12 273/157 R
3,589,057 A 6/1971 Fechner et al.
3,881,284 A 5/1975 Martin
4,051,621 A 10/1977 Hogan
4,075,813 A 2/1978 Nalick
4,079,541 A 3/1978 Hogan
4,219,961 A 9/1980 Stiles
5,100,359 A 3/1992 Gorio
5,261,194 A 11/1993 Roberts
5,329,737 A 7/1994 Roberts et al.
(Continued)

FOREIGN PATENT DOCUMENTS

EP 0862034 A1 * 9/1998 ..... F27D 1/025
JP 2008115572 A * 5/2008

OTHER PUBLICATIONS

Vadnal, Jane, "Glossary of Medieval Art and Architecture", May 1997 (retrieved May 23, 2019), Retrieved from the Internet . (Year: 1997).*

(Continued)

*Primary Examiner* — Steven B Wong

(74) *Attorney, Agent, or Firm* — Dunlap, Bennett & Ludwig PLLC

(57) ABSTRACT

An arch puzzle includes a base having a substantially flat upper surface, a first ridge protruding upward from the upper surface at a first side, and a second ridge protruding upward from the upper surface at a second side. A notch is defined the first and second ridge. An arch support has a semi-circular block shape. A plurality of arch pieces have a keystone shape. At least a first pair of shims each include an elongated body having a tapered upper surface and a horizontal lower surface.

5 Claims, 4 Drawing Sheets

(56) References Cited

U.S. PATENT DOCUMENTS

| | | | | |
|---|---|---|---|---|
| 6,076,318 | A | 6/2000 | Grimm et al. | |
| 6,526,703 | B2 | 3/2003 | Huang et al. | |
| 2003/0159370 | A1* | 8/2003 | Drew | E01D 4/00 52/89 |
| 2003/0213186 | A1 | 11/2003 | Geiger | |
| 2005/0029735 | A1* | 2/2005 | Liu | A63F 9/12 273/156 |
| 2008/0053012 | A1* | 3/2008 | Scanlan | E04G 21/1866 52/204.2 |
| 2009/0113815 | A1 | 5/2009 | Woodcock | |
| 2014/0093691 | A1* | 4/2014 | Shray | B29C 44/583 428/156 |
| 2015/0190725 | A1 | 7/2015 | Berglund et al. | |
| 2017/0067215 | A1* | 3/2017 | Bennett | E01D 22/00 |
| 2018/0073261 | A1* | 3/2018 | Simonson | E04B 1/02 |

OTHER PUBLICATIONS

Screen captures from YouTube video clip entitled "Free Standing Stone Arch", 1 page, uploaded on Mar. 6, 2017 by user Rich Harman. Retrieved from internet: (Year: 2017).*

* cited by examiner

THREE-DIMENSIONAL ARCH PUZZLE

CROSS-REFERENCE TO RELATED APPLICATION

This application claims the benefit of priority of U.S. provisional application No. 62/598,681, filed Dec. 14, 2017, the contents of which are herein incorporated by reference.

BACKGROUND OF THE INVENTION

The present invention relates to creating arches and, more particularly, to a three-dimensional arch puzzle.

Since ancient times, the arch has been used in architectural construction to enable the builder to span distances greater than the length of an individual block and, at the same time, provide support to any weight over the arch.

The construction of an arch with blocks is usually somewhat time consuming and complex because the blocks must be individually formed or cut to shape. Although one basic shape can be used for the inner curve of the arch, the blocks which form around the curve must be custom fit. Because of these complexities, arches built entirely from blocks are not very common in architectural construction or toy block sets today.

As can be seen, there is a need for a three-dimensional arch puzzle.

SUMMARY OF THE INVENTION

In one aspect of the present invention, an arch puzzle comprises: a base comprising a substantially flat upper surface, a first ridge protruding upward from the upper surface at a first side, and a second ridge protruding upward from the upper surface at a second side, wherein a notch is defined therebetween; an arch support having a semi-circular block shape; a plurality of arch pieces having a keystone shape; and at least a first pair of shims each comprising an elongated body having a length, a width, and a depth, the depth gradually increasing from a first end to a second end defining a sloped upper surface and a horizontal lower surface.

In another aspect of the present invention, a method of making an arch comprises steps of: providing an arch puzzle comprising: a base comprising a substantially flat upper surface, a first ridge protruding upward from the upper surface at a first side, and a second ridge protruding upward from the upper surface at a second side, wherein a notch is defined therebetween; an arch support having a semi-circular block shape; a plurality of arch pieces having a keystone shape; and at least a first pair of shims each comprising an elongated body having a length, a width, and a depth, the depth gradually increasing from a first end to a second end defining a sloped upper surface and a horizontal lower surface, placing the sloped upper surfaces of the first pair of shims against each other and placing the pair of shims in the notch; placing the arch support on top of the pair of shims; placing each of the plurality of arch pieces along an upper edge of the arch support forming an arch with the plurality of arch pieces.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a stone, wood, and clay three-dimensional arch puzzle. The present invention can easily be assembled and disassembled on a small flat surface. Further, the present invention does not require knowledge of a language, and can help perpetuate best known practices in the construction of arches.

Figure 1:
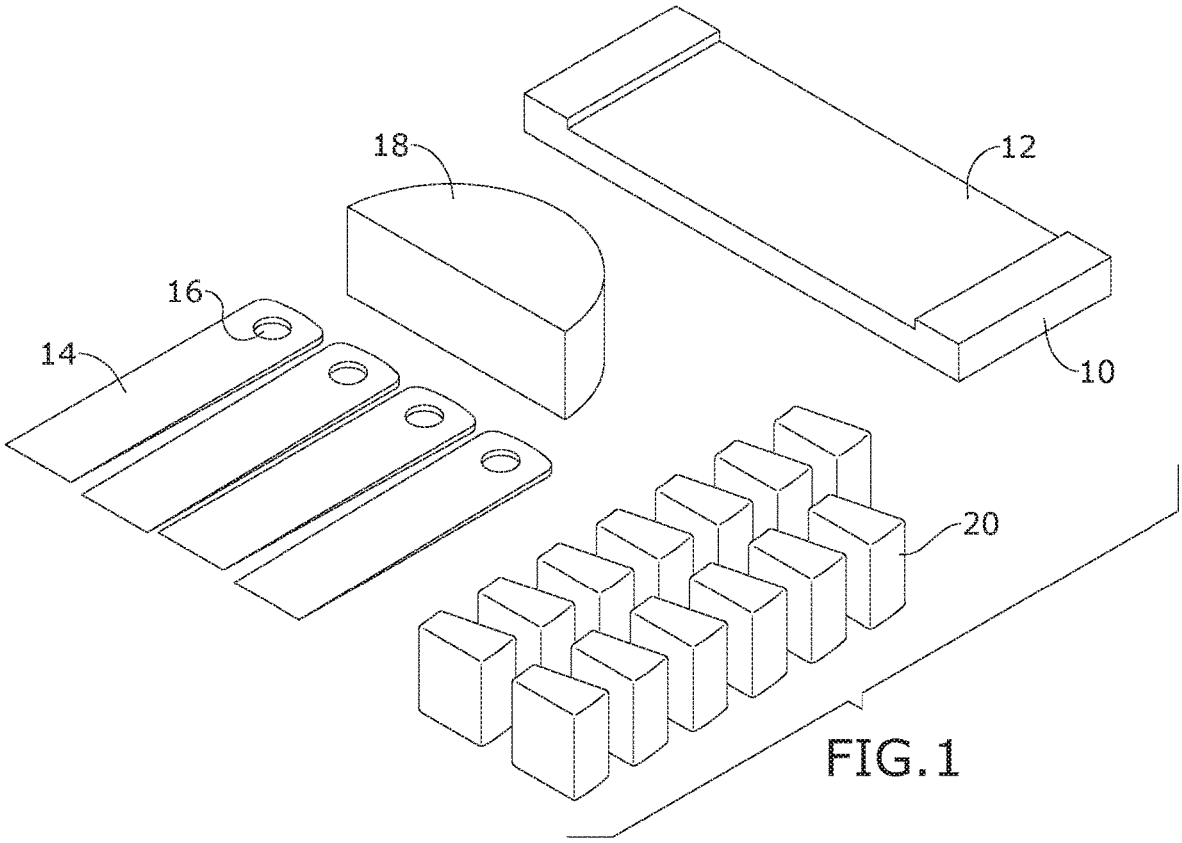
FIG. 1 is a perspective view of an embodiment of the present invention.
Figure 2:
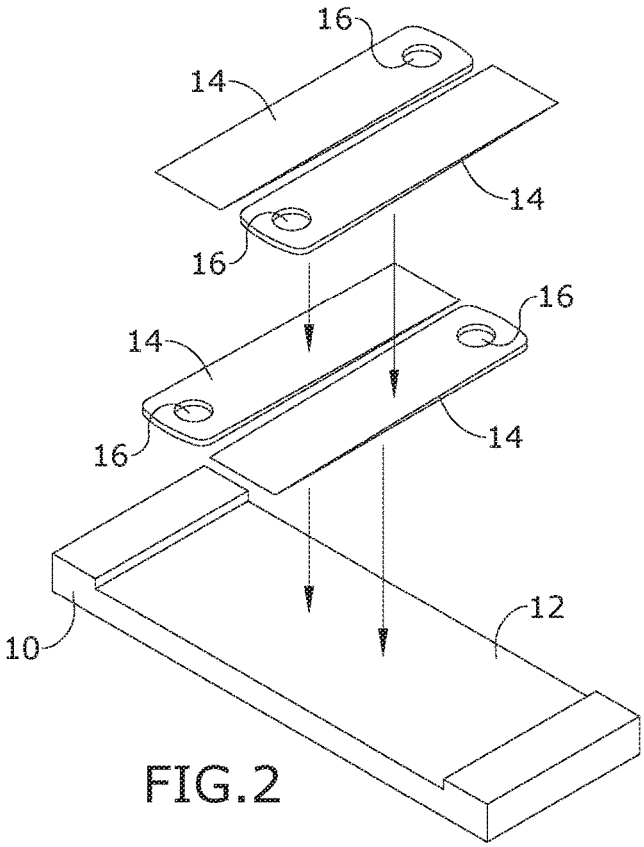
FIG. 2 is a perspective view of an embodiment of the present invention, illustrating placement of shims.
Figure 3:
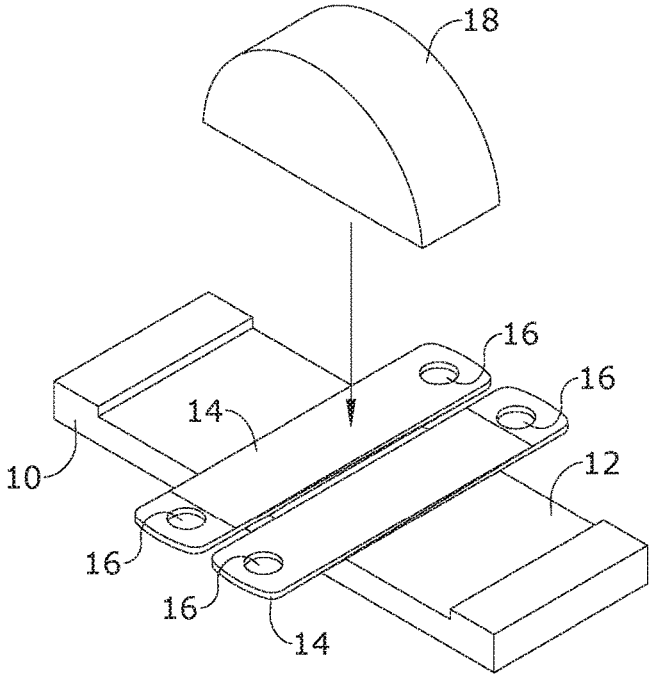
FIG. 3 is a perspective view of an embodiment of the present invention, illustrating placement of an arch support.
Figure 4:
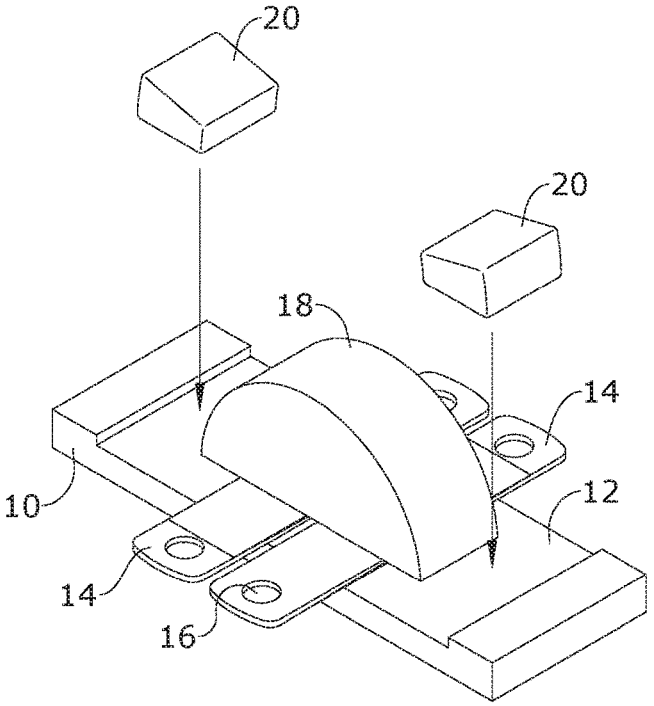
FIG. 4 is a perspective view of an embodiment of the present invention, illustrating placement of arch pieces.
Figure 5:
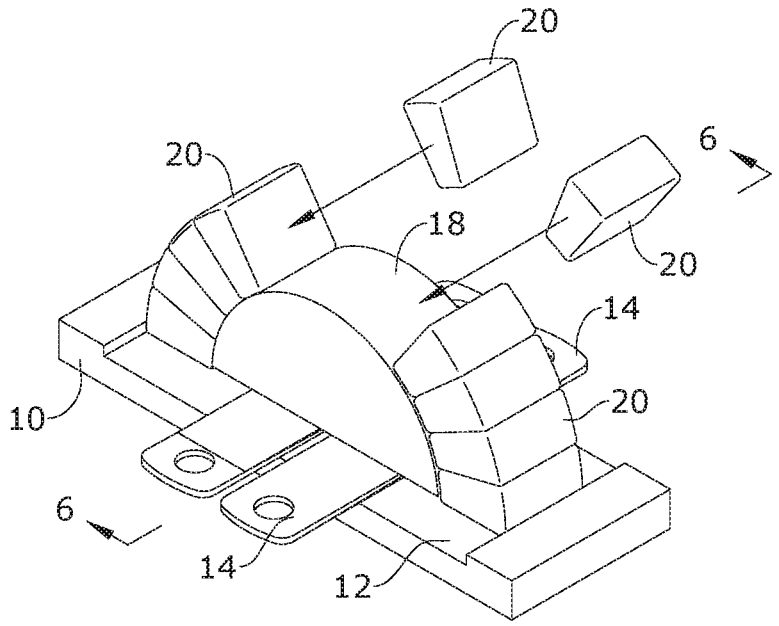
FIG. 5 is a perspective view of an embodiment of the present invention, illustrating placement of arch pieces.
Figure 6:
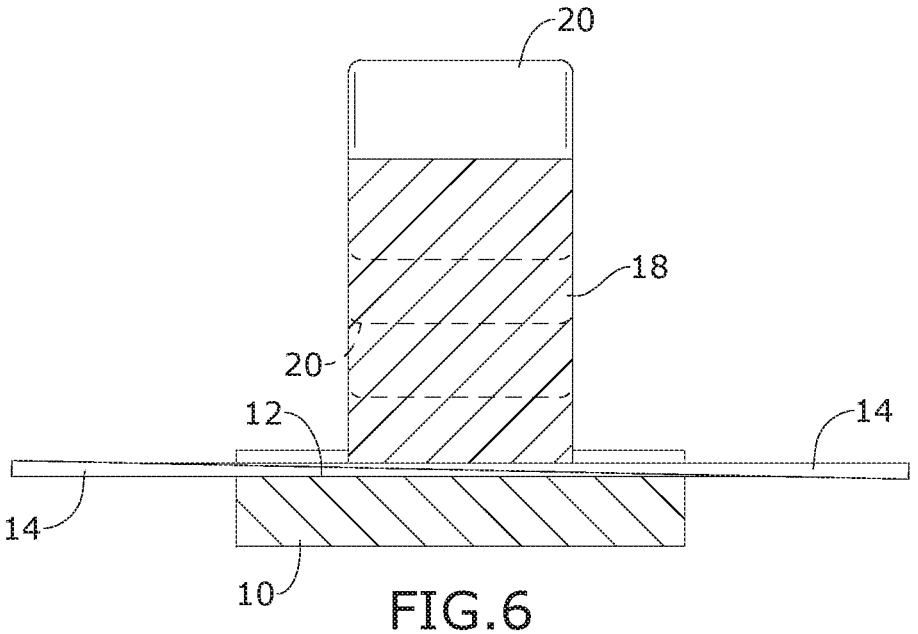
FIG. 6 is a section view of the present invention taken along line 6-6 of FIG. 5.
Figure 7:
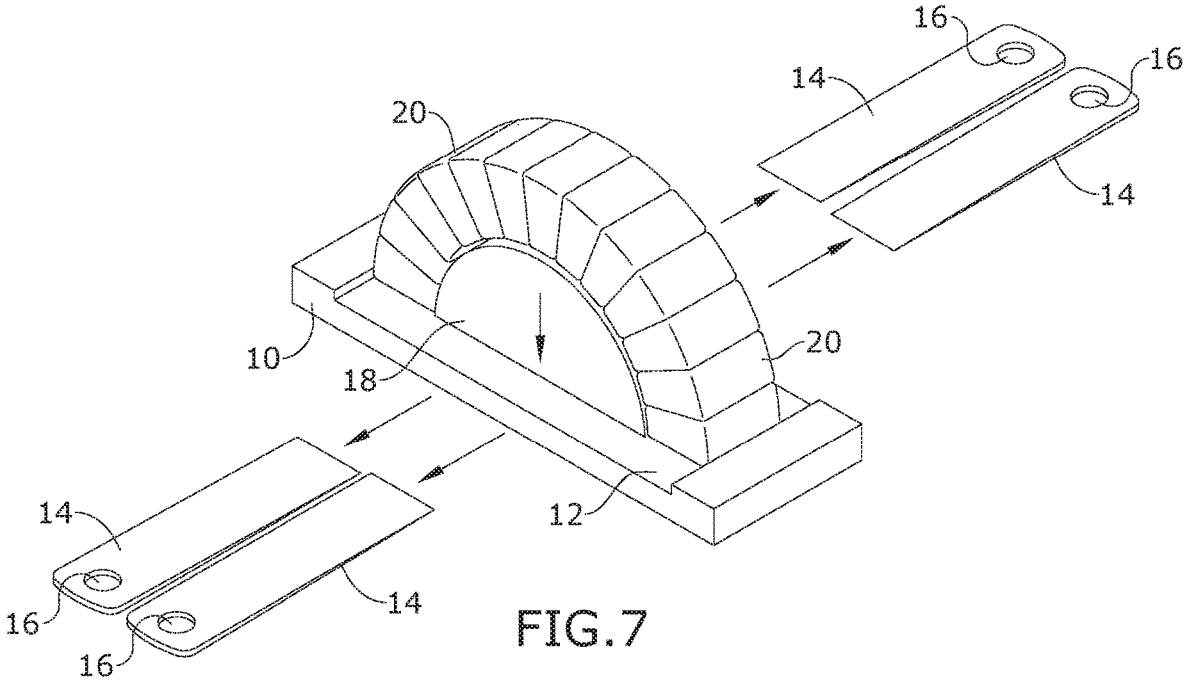
FIG. 7 is a perspective view of an embodiment of the present invention, illustrating removal of the shims.
Figure 8:
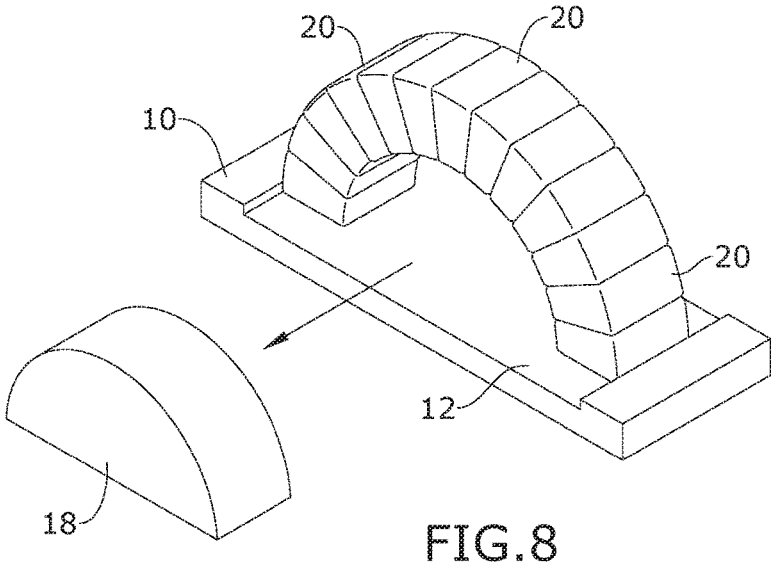
FIG. 8 is a perspective view of an embodiment of the present invention, illustrating removal of the arch support.

Referring to FIGS. 1 through 8, the present invention includes an arch puzzle. The arch puzzle includes a base 10 having a substantially flat upper surface, a first ridge protruding upward from the upper surface at a first side, and a second ridge protruding upward from the upper surface at a second side. A notch 12 is defined between the first and second ridge. The arch puzzle further includes an arch support 18 having a semi-circular block shape. A plurality of arch pieces 20 have a keystone shape. At least a first pair of shims 14 each include an elongated body having a length, a width, and a depth, the depth gradually increasing from a first end to a second end defining a sloped upper surface and a horizontal lower surface.

The base 10 may be made of wood. The base 10 is used to hold the other pieces in place and to support the arch. Therefore, the upper surface of the base 10 is substantially flat and lies within a horizontal plane.

The arch support 18 may also be made of wood. The arch support 18 temporarily supports the arch pieces 20 when constructing the arch. The arch support 18 includes an upper edge having an arc shape to place the arch pieces 20 on top of.

As mentioned above, the arch pieces 20 may include a keystone shape. The keystone shape includes tapered sidewalls forming a wedge and a bottom edge having an arc shape. The plurality of arch pieces 20 may be made of clay or stone. The arch pieces 20 are used to construct the arch.

As mentioned above, the first pair of shims 14 each include an elongated body having a length, a width, and a depth, the depth gradually increasing from a first end to a second end defining a sloped upper surface and a horizontal lower surface. The present invention may utilize a second pair of shims 14 each having the elongated body having the a length, a width, and a depth, the depth gradually increasing from a first end to a second end defining a sloped upper surface and a horizontal lower surface. Each of the shims 14 may include an opening 16 defined at the first end. Each of the shims 14 may be made of wood. The shims 14 are used to temporarily support the arch support 18.

A method of making an arch using the arch puzzle may include the following. Place the sloped upper surfaces of the first pair of shims 14 against each other to form a rectangular cuboid shape. Place the sloped upper surfaces of the second pair of shims 14 against each other to form a rectangular cuboid shape. Place the first and second pair of shims 14 onto the upper surface of the base 10 within the notch 12. Place the arch support 18 on top of the first and second pair of shims 14. Place each of the plurality of arch pieces 20 along an upper edge of the arch support 18 forming an arch with the plurality of arch pieces 20. Remove the first and second pair of shims 14 from the notch 12 by grasping the opening 16 and pulling the shims 14 away from the base 10. Remove the arch support 18 from the notch 12 by pushing the arch support 18 off of the upper surface of the base 10. The arch may of the arch pieces is left standing on the base 10.

The components of the present invention demonstrate how stone arches are made using best known practices. The wood base holds the temporary wood supports as well as the permanent stone arch pieces. The wood shims rest on top of the wood base, and beneath the wood semi-circle. The wood semicircle rests on the shims and supports the stone arch pieces while being built. The arch pieces support themselves using friction and gravity after the wood shims and wood semicircle are removed.

It should be understood, of course, that the foregoing relates to exemplary embodiments of the invention and that modifications may be made without departing from the spirit and scope of the invention as set forth in the following claims.

What is claimed is:

1. A method of making an arch comprising steps of:

providing an arch puzzle comprising:

a base comprising a substantially flat upper surface, a first ridge protruding upward from the upper surface at a first side, and a second ridge protruding upward from the upper surface at a second side, wherein a notch is defined therebetween;

an arch support having a semi-circular block shape;

a plurality of arch pieces having a keystone shape; and at least a first pair of shims each comprising an elongated body having a length, a width, and a depth, the depth gradually increasing from a first end to a second end defining a sloped upper surface and a horizontal lower surface;

placing the sloped upper surfaces of the first pair of shims against each other to form a rectangular cuboid shape and placing the pair of shims on the substantially flat upper surface in the notch;

placing the arch support on top of the pair of shims;

placing each of the plurality of arch pieces along an upper edge of the arch support forming an arch with the plurality of arch pieces; and pulling the pair of shims out from underneath the arch support.

2. The method of claim 1, further comprising a step of:

removing the arch support from the notch.

3. The method of claim 1, further comprising a second pair of shims each comprising an elongated body having a sloped upper surface and a horizontal lower surface.

4. The method of claim 3, wherein each of the first pair of shims and the second pair of shims comprise an opening defined at a first end.

5. The method of claim 1, wherein each of the plurality of arch pieces are made of clay or stones.

* * * * *